United States Patent [19]

Demeter

[11] 4,443,942

[45] Apr. 24, 1984

[54] TOOL FOR TRIMMING LAPPING EDGE PORTIONS OF SHEET MATERIAL

[76] Inventor: Paul J. Demeter, 36 Stoneleigh Ave., Buffalo, N.Y. 14223

[21] Appl. No.: 379,278

[22] Filed: May 17, 1982

[51] Int. Cl.[3] ..... B26B 26/60

[52] U.S. Cl. ..... 30/293; 30/294

[58] Field of Search ..... 30/289, 293, 294, 319; 269/1; 33/32 R, 32 C, 41 E, 18 R

[56] References Cited

U.S. PATENT DOCUMENTS

| | | | |
|---|---|---|---|
| 1,589,156 | 8/1922 | Hartman . | |
| 1,776,046 | 9/1930 | Schmidt | 30/293 |
| 2,603,866 | 5/1950 | Rice | 30/294 |
| 3,079,688 | 3/1963 | Ryan | 30/294 |
| 3,085,330 | 4/1963 | Lewinski | 30/293 |
| 3,407,498 | 10/1968 | Young | 30/293 |
| 3,543,400 | 10/1968 | Scott et al. | 30/280 |
| 3,613,239 | 5/1969 | Porrelli | 30/293 |
| 3,859,725 | 1/1975 | Anderson et al. | 30/294 |
| 4,095,340 | 6/1978 | Kingsley | 30/287 |
| 4,148,142 | 4/1979 | Sullivan et al. | 30/294 |

*Primary Examiner*—E. R. Kazenske
*Assistant Examiner*—Douglas D. Watts
*Attorney, Agent, or Firm*—Bean, Kauffman & Bean

[57] ABSTRACT

A tool for trimming lapping edge portions of sheet material, such as linoleum, to form a butt seam. The tool includes a roller supported base intended to be moved lengthwise of and in a straddling relationship relative to the overlapping portions; a tool operating handle pivotally supported on the base and fitted with a cutting blade; a lock device for selectively retaining the handle in either blade change or cutting/carrying positions; and an adjustment device for selectively controlling the depth of cut of the blade, while in its cutting/carrying position, such that the depth of cut is independent of pressure applied by an operator to the handle for purposes of effecting movement of the tool lengthwise of the overlapping edge portions during a seam cutting operation.

13 Claims, 4 Drawing Figures

TOOL FOR TRIMMING LAPPING EDGE PORTIONS OF SHEET MATERIAL

BACKGROUND OF THE INVENTION

The present invention relates to a tool for trimming adjacent overlapping edge portions of sheet material in order to form a butt seam.

In connection with the application of floor and wall coverings by means of adhesive, it is known to overlap edge portions of adjacent sheets of material to be applied by a small amount; to employ a tool fitted with a blade to cut down the approximate center of the overlapping edge portions; and then to remove the cut off edge portions of both layers of material to permit the freshly cut edges of the sheets to form an evenly matched butt seam.

SUMMARY OF THE INVENTION

The present invention is directed towards an improved tool for use in trimming adjacent overlapping edge portions of sheet material, and more particularly, floor covering such as linoleum, in order to provide an accurately formed butt seam.

The tool of the present invention comprises a roller supported base intended to be moved lengthwise of and in a straddling relationship relative to the overlapping edge portions of a pair of sheets; a tool operating handle pivotally supported on the base and fitted with a cutting blade; a lock device for selectively retaining the handle in either blade change or cutting/carrying positions; and an adjustment device for selectively controlling the depth of cut of the blade, while in its cutting/carrying position, such that the depth of cut is independent of pressure applied by an operator to the handle for purposes of effecting movement of the tool lengthwise of the overlapping edge portions during a seam cutting operation.

The present tool is of compact, light weight design and permits cutting of an accurate seam with a minimum of physical exertion on the part of a tool operator.

DRAWINGS

The nature and mode of operation of the present invention will now be more fully described in the following detailed description taken with the accompanying drawings wherein.

DETAILED DESCRIPTION

Figure 1:
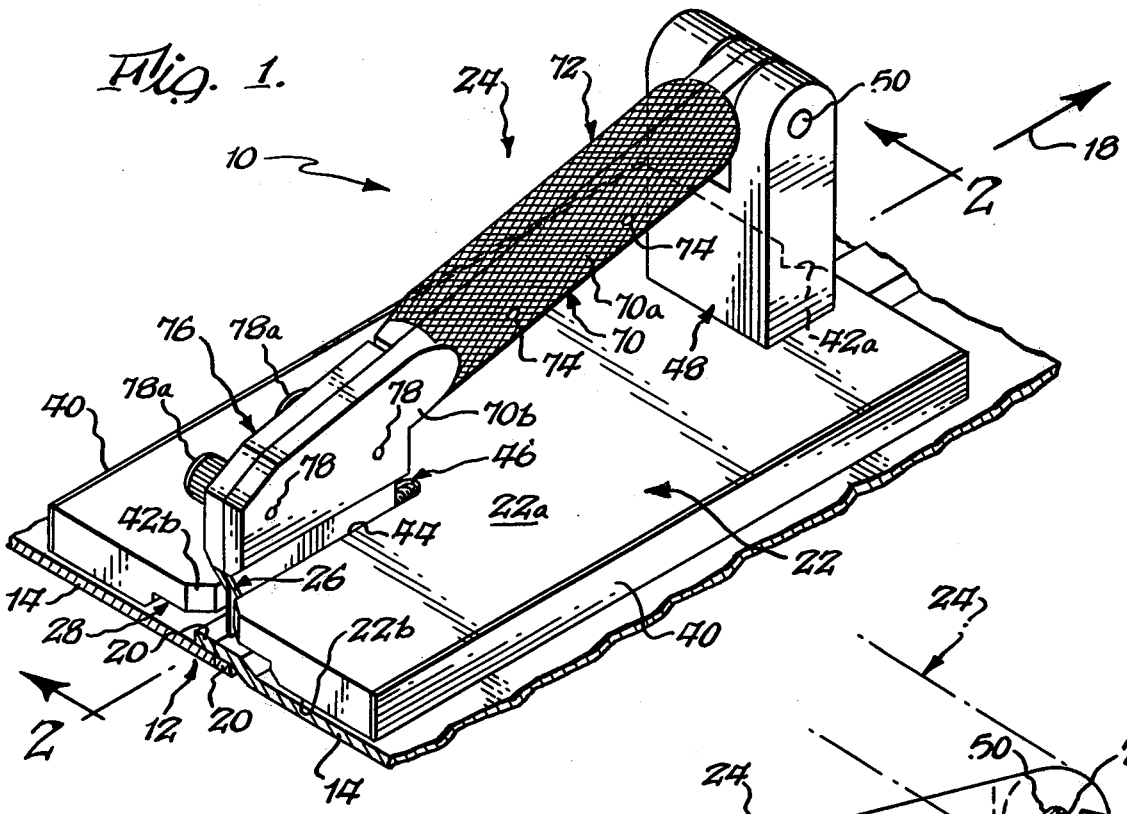
FIG. 1 is a rear perspective view of the tool of the present invention.
Figure 3:
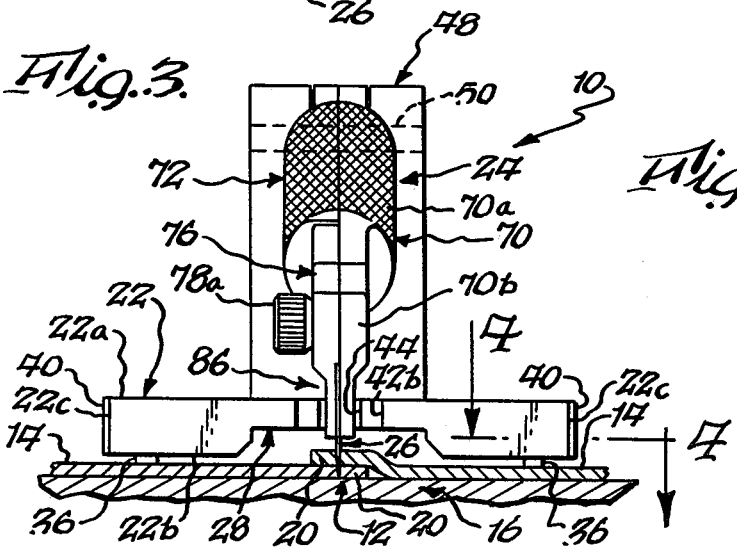
FIG. 3 is a rear end elevational view, as viewed from the left hand side in FIG. 1.

Reference is first made to FIGS. 1 and 3, wherein a tool formed in accordance with a preferred form of the present invention is generally designated as 10 and shown as being employed to form a butt seam 12 by simultaneously cutting overlapping edge portions of a pair of sheets 14 and 14 of a suitable material, such as linoleum, adhered to a sub-surface 16, such as a floor, as tool 10 is moved by an operator lengthwise of the overlapping edge portions in the direction indicated by arrow 18. After the cutting operation has been completed, the cutoff or severed edge portions 20 and 20 are removed and the freshly cut edges of sheets 14 and 14 arranged to form an evenly matched butt seam whose edges are disposed at essentially 90° to the planar surfaces of the sheets.

Reference is again made particularly to FIGS. 1 and 3, wherein tool 10 is shown as generally comprising a base 22 and an operating handle 24, which serves to removably mount a commercially available cutting blade 26 and is adapted to be gripped by the hand of an operator for the purpose of effecting movement of the tool to perform a cutting operation.

Figure 4:
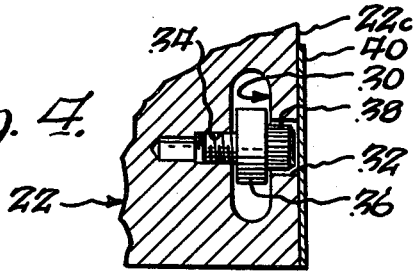
FIG. 4 is a sectional view taken generally along the line 4—4 in FIG. 3.

Base 22 is characterized as having a generally rectangular plan view configuration, a planar upper surface **22*a* and a planar lower surface 22*b* formed with a centrally disposed and lengthwise extending clearance recess 28 and four corner recesses 30, only one of which is shown in FIG. 4. The lengthwise extending side walls 22*c* of base 22 are formed with four bore openings 32, only one of which is shown in FIG. 4, which communicate one with each of corner recesses 30, and four blind openings 34, again only one of which is shown in FIG. 4, which are disposed one in alignment with each of bore openings 32. Corner openings 30 are sized to freely receive ball bearing rollers or wheels 36, which are mounted within their associated corner openings by screw devices 38 for rotation about axes arranged normal to the direction of intended movement of tool 10. By making reference to FIG. 3, it will be understood that the depth and width of clearance recess 28 is sufficient to avoid contact between base 22 and the uppermost of the lapped edge portions, when the base is arranged in a straddling relationship to the lapped edge portions with its rollers 36 arranged in engagement with the upper or exposed surfaces of sheets 14**.

In the presently preferred construction, the head ends of screw devices 38, as well as bore openings 32, are hidden from view by a pair of formica or other suitable plastic strips 40, which enhance sliding of tool 10 along a guide, not shown, if same is used by a tool operator to facilitate the cutting operation.

Figure 2:
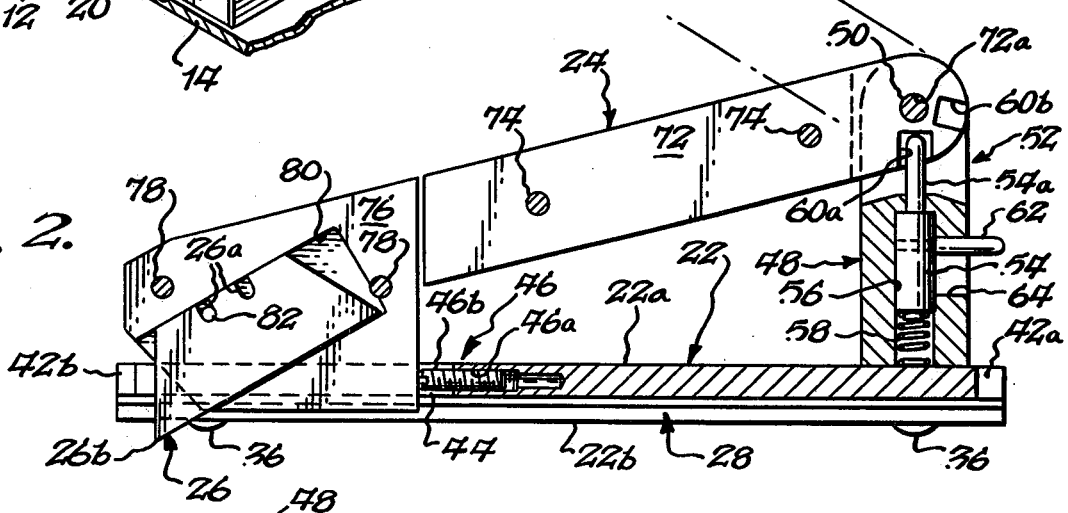
FIG. 2 is a sectional view taken generally along line 2—2 in FIG. 1.

Reference is now made to FIGS. 1 and 2, wherein the relatively front and rear ends of base 22 are shown as being formed with V-shaped sight openings **42*a* and 42*b*, respectively, which are bisected by a vertical plane extending lengthwise and centrally of clearance recess 28. The inner end of rear sight opening 42*b* communicates with a guide slot 44, in which is positioned a suitable adjustment device 46 adapted for use in selectively controlling the depth of cut of blade 26. Adjustment device 46 is preferably in the form of an opening 46*a*, which is threaded to receive an adjustment screw 46*b* for adjustment in a direction extending lengthwise of guide slot 44. The outwardly projecting end of adjustment screw 46*b* would preferably be provided with a slot sized to receive the blade of a screw driver to facilitate adjustments in the positioning thereof within opening 46*a***.

The forward end of base 22 carries an upstanding post 48, which may be suitably attached to the base, as by threaded fasteners, not shown, and in turn serves to mount a pivot pin 50 by which a forwardly disposed end of handle 24 is mounted to permit pivotal movements of the handle within a vertical plane extending lengthwise of base 22 between blade change and cutting/carrying positions thereof shown in broken and full line, respectively, in FIG. 2. In accordance with the preferred construction a lock device generally designated as 52 is employed to selectively and releasably retain handle 24 in either of its blade change and cutting/carrying positions. Lock device 52 includes a plunger 54, which is slidably mounted within a stepped diameter bore opening 56 extending vertically through post 48. Plunger 54 is normally maintained in an operative position thereof shown in FIG. 2 by means of a coil spring 58 having its opposite ends engaged with the plunger and base upper surface 22*a*, such that the upper or locking end portion 54*a* of the plunger is inserted within one or the other of a pair of locking recesses 60*a* and 60*b* formed in handle 24 and spaced apart circumferentially of pivot pin 50. End portion 54*a* may be selectively removed from within recesses 60*a* and 60*b* against the bias of spring 58 in order to permit pivotal movement of arm 24 between its above described positions by means of a manually operable pin 62, which is suitably fixed to plunger 54 and slidably received within a vertical slot 64 arranged in communication with bore opening 56.

To facilitate construction, handle 24 is preferably of a three part construction, including a main handle part 70 having hand grip and blade mounting portions 70*a* and 70*b*, respectively; a hand grip part 72, which is suitably fixed to hand grip portion 70*a* as by means of threaded fasteners 74; and a cover part 76, which is removably fixed to blade mounting portion 70*b* by suitable means such as threaded fasteners 78 having enlarged head portions 78*a* to facilitate gripping thereof by the fingers of an operator for purposes of loosening and tightening the threaded fasteners. It will be understood that hand grip portion 70*a* is formed with a bearing opening, not shown, which is disposed for alignment with a bearing opening 72*a* formed in hand grip part 72 for purposes of journaling pivot pin 50; and that recesses 60*a* and 60*b* may be formed by aligned recesses provided in the mating surfaces of hand grip portion 70*a* and hand grip part 72. Also, it will be noted that hand grip portion 70*a* and hand grip part 72 cooperate to define a generally cylindrical hand grip having a knurled surface to aid in gripping thereof by the hand of an operator.

Reference is again made to FIG. 2, wherein blade 26 is depicted as being of a standard commercially available construction and shown as being positionally located relative to the rear end of handle 24 by providing the inwardly facing surface of cover part 76 with a blade receiving/clamping recess 80, which has a depth made preferably slightly less than the thickness of the blade. Alternately, recess 80 may be placed in blade mounting portion 70*b* or defined by aligned recesses formed in facing surfaces of the blade mounting portion and cover part 76. Blade 26 may be locked against movement lengthwise of recess 80 by means of a pin 82, which projects from the inner surface of blade mounting portion 70*b* for receipt within a selected one of blade retaining slots 26*a* typically found in blades of standard construction. Recess 80 is sized and the placement of pin 82 is such as to accommodate tool 10 for use with standard sizes of light and heavy duty blades depending on the sheet material to be cut. In this connection, it will be understood that the positioning of the lower end or tip 26*b* of the blade cutting edge relative to blade mounting portion 70*b* and cover part 76 will vary depending on the type of blade employed, that is, its size and number and placement of its retaining slots 26*a*.

It will be noted that the lower edge portions of blade mounting portion 70*b* and cover part 76 are inset, as best shown in FIG. 3, and cooperate to define a guide portion 86, which is slidably received within guide slot 44 and arranged to abut against the projecting end of adjustment screw 46*b*, whenever arm 24 is arranged in its cutting/carrying position. It will also be noted by viewing FIG. 2, that locking recess 60*a* is sized relative to plunger locking end portion 54*a*, such as to permit vertical displacements of guide portion 86 within guide slot 44, and thus some given range of movement of blade 26 relative to base 22, while arm 24 remains latched in its cutting/carrying position, with the lowermost position of guide portion 86 and thus the distance of blade lower end 26*b* from the base being determined by the adjusted position of adjustment screw 46*b*.

Tool 10 may be fabricated from any suitable material, but aluminum is preferably employed in fabricating base 22, handle 24 and post 48.

Prior to operation of tool 10, handle 24 would be placed in its blade change position to free the hands of an operator for blade installation purposes. After installation of blade 26, lock device 52 would be released to permit movement of handle 24 into its carrying/cutting position, wherein it would be latched upon insertion of plunger end portion 54*a* within recess 60*a*. If with guide portion 86 engaged with adjustment screw 46*b*, blade lower end 26*b* projects a desired distance below base 22, that is, by an amount sufficient to cut clearly through the lowermost of the overlapping sheets 14 when rollers 36 engage with the upper surfaces of both sheets in the manner shown in FIG. 3, the operator may proceed with the cutting operation. On the other hand, if the placement of blade lower end 26*b* is such that it will not sever the lowermost sheet or will tend to produce an undesired score line in subsurface 16, it is necessary to move handle 24 from its carrying/cutting position to expose the projecting end of adjustment screw 46*b* in order to permit adjustment thereof, as required to properly position blade lower end 26*b* when the handle is again placed in its carrying/cutting position. Adjustments of adjustment screw 46*b* will be required to accommodate for variations in the thickness of sheets being cut, as will changes of blades between light and heavy duty blades due to variation in the positioning of their blade lower ends relative to guide portion 86.

After any required adjustments are made to achieve desired positioning of blade 26, the operator would then place tool 10 in a straddling relationship to the overlapping edge portion of sheets 14 with blade 26 arranged to cut downwardly through the approximate center thereof and then by pressure exerted on handle 24, push tool 10 lengthwise of the overlapping edge portions in the manner indicated in FIG. 1. During the cutting operation, the operator may use a suitable straight edge, not shown, to guide tool 10 or he may rely on sight opening 42*a* and/or 42*b* as a convenient visual cutting guide.

It will be noted that handle 24 slopes downwardly and rearwardly when disposed in its carrying/cutting position, such that operator pressure is conveniently resolved into a vertical force tending to maintain blade 26 in proper cutting position and a horizontal force tending to move tool 10 lengthwise of the overlapping edge portions of the sheets. The operator need not be concerned about exerting excessive working pressure on blade 26 since its depth of cut is limited by adjustment screw 46*b* and all force beyond that required to cause the blade to penetrate sheets 14 is transferred by the adjustment screw from handle 24 to base 22 and not to the blade. The provision of rollers 36 permit tool 10 to move smoothly during the cutting operation regardless of the amount of manual pressure applied thereto by the operator. The provision of recess 28 of sufficient depth and width prevents engagement of base 22 with the uppermost of the lapped edge portions, which would otherwise result in undesired frictional effects and tilting of blade 26, such as might cause breakage thereof and/or prevent formation of freshly cut edges disposed at 90° to the exposed surfaces of sheets 14.

At the completion of a cutting operation, the operator may wish to again adjust adjustment screw **46*b* in order to raise blade lower end 26*b* to a point above a plane drawn tangent to the lower surfaces of rollers 36 and preferably to a point within the confines of guide slot 44 in order to space the blade from a surface on which tool 10 may be placed for storage purposes and thereby avoid damage to the blade and/or such surface. In any event, when handle 24 is in its carrying/cutting position, it serves as a convenient means for transporting tool 10 from place to place, and in cooperation with base 22 and post 48 provides a compact tool requiring little storage space. Moreover, since as previously noted, handle 24 and blade 26 are free to undergo a range of movements relative to base 22 while the handle is latched in its carrying/cutting position, which movements are only partially restricted by normal settings of adjustment screw 46*b*, the picking up of tool 10 by its handle automatically causes the blade to be drawn or move upwardly within guide slot 44 so as to minimize the likelihood of injury to the operator or others while the tool is carried from place to place. If desired, the design of tool 10 may be such as to permit the cutting edge of blade 26 to be completely shielded by base 22, while tool 10** is being carried by the operator.

While only a preferred form of the tool of the present invention has been described in detail, it is anticipated that various obvious modifications thereof will likely occur to those skilled in the art upon examination of the foregoing specification. As by way of example, one such modification would be to place the adjustment screw on the handle in a position convenient to permit adjustments thereof without requiring removal of the handle from its carrying/cutting position. Accordingly, it is intended that the scope of protection to be afforded the present invention be limited only by the appended claims.

What is claimed is:

1. A tool for trimming lapping edge portions of a pair of sheets to form a butt seam therebetween, said tool comprising in combination:

a base having front and rear ends and means for supporting said base on exposed surfaces of said sheets in a straddling and non-contacting relation to said lapping edge portions and for movement in a direction extending lengthwise thereof;

a handle having a front end and a rear end for removably mounting a sheet cutting blade;

pivot means for pivotally mounting said front end of said handle on said front end of said base to permit movement of said handle, with said blade disposed within a plane extending normal to said base and in alignment with said direction, between positions in which said blade projects below said base for purposes of cutting said sheets and in which said blade is disposed above said base to facilitate changing of said blade;

locking means for releasably locking said handle in a carrying/cutting position wherein said handle may freely undergo a limited range of movement relative to said base for permitting the distance said blade projects below said base to be varied for purposes of adjustment of the depth of cut of said blade, the extent of said range of movement being less than the extent of movement of said handle permitted by said pivot means; and adjustment means for limiting movement of said handle within said range of movement in a direction relatively towards said base for adjustably varying the distance said blade may be projected below said base by tool operator applied force exerted on said handle, while permitting the picking up of said tool by said handle to move said handle within said range of movement in a direction relatively away from said base to reduce the distance said blade projects below said base.

2. A tool according to claim 1, wherein said base includes a guide slot arranged adjacent said rear end of said base in alignment with said direction; said rear end of said handle is received within said guide slot when in said carrying/cutting position, and said means for releasably locking said handle is operable to releasably lock said handle in a blade change position wherein said rear end of said handle and said blade is removed from within said guide slot.

3. A tool according to claim 2, wherein said adjustment means is a screw carried by said base and projecting into said guide slot for engagement with said rear end of said arm.

4. A tool according to claim 2 or 3, wherein said base carries a post upstanding from said front end thereof, said front end of said handle is pivotally mounted on said post, and said means for releasably locking said handle includes a plunger supported by said post, two locking recesses formed in said front end of said handle and spaced apart annularly of an axis about which said handle pivots, spring means for biasing said plunger for receipt within said locking recesses, and manually operable means for removing said plunger from within said locking recesses against the bias of said spring to permit pivotal movement of said handle, one of said locking recesses cooperating with said plunger to define said carrying/cutting position and the other of said locking recesses cooperating with said plunger to define said blade change position.

5. A tool according to claim 1, wherein said base is of generally rectangular plan view configuration, carries four corner mounted rollers for supporting said base on said exposed surfaces for movement in said direction and is formed with a lengthwise extending clearance recess sized to prevent engagement of said base with said lapping edge portions when said base is arranged to position said rollers in engagement with said exposed surfaces and in straddling relation to said lapping edge portions.

6. A tool according to claim 5, wherein said rear end of said handle defines a guide portion through which said blade extends, and said base is formed with a guide slot adjacent a rear end thereof sized to removably slidably receive said guide portion when said handle is in said carrying/cutting position.

7. A tool according to claim 6, wherein said means for releasably locking said handle is operable to releasably lock said handle in a blade change position wherein said guide portion and said blade are removed from within said guide slot.

8. A tool according to claim 5 or 6, wherein said adjustment means includes an adjustment screw arranged to project into said guide slot for engagement with said guide portion.

9. A tool according to claim 1, wherein said base is of generally rectangular plan view configuration having upper and lower surfaces joined by lengthwise extending side surfaces, said lower surface having four corner openings located adjacent the corners thereof and a centrally disposed lengthwise extending clearance recess, said base having bore openings extending through said side surfaces for communication one with each of said corner openings, blind openings communicating with said corner openings and arranged one in alignment with each of said bore openings, rollers freely received one within each of said corner openings for supporting said tool on said exposed surfaces for movement in said direction, screw devices received within aligned ones of said bore and blind openings for mounting said rollers for rotation relative to said base, and strips of friction reducing material fixed to said side surfaces to overlie said bore openings and said screw devices, said clearance recess being sized to prevent engagement of said base with said lapping edge portions when said base is arranged to position said rollers in engagement with said exposed surfaces and in straddling relation to said lapping edge portions.

10. A tool according to claim 9, wherein said base is formed with a guide slot opening through said upper and lower surfaces adjacent said rear end of said base, said means for pivotally mounting said front end of said handle includes a post upstanding from said upper surface adjacent a forward end thereof, and said rear end of said handle includes a guide portion from which said blade projects, said guide portion being removably slidably received within said guide slot when said handle is in said carrying/cutting position.

11. A tool according to claim 10, wherein said adjustment means includes an adjustment screw projecting into said guide slot from adjacent a forward end thereof for engagement with said guide portion.

12. A tool according to claim 11, wherein said means for releasably locking said handle includes a plunger supported by said post, two locking recesses formed in said front end of said handle and spaced apart annularly of an axis about which said handle pivots, spring means for biasing said plunger for receipt within said locking recesses, and manually operable means for removing said plunger from within said locking recesses against the bias of said spring to permit pivotal movement of said handle, one of said locking recesses cooperating with said plunger to define said carrying/cutting position and the other of said locking recesses cooperating with said plunger to define a blade change position wherein said guide portion and said blade are removed from within said guide slot.

13. A tool according to claim 12, wherein said handle is of a three part construction including a main handle part having hand grip and blade mounting portions, a hand grip part fixed to said hand grip portion and cooperating therewith to define a generally cylindrical hand grip and said front end of said handle, and a cover part removably fixed to said blade mounting portion for removably mounting said blade and cooperating therewith to define said guide portion, and said handle slopes downwardly and rearwardly from said post towards said rear end of said base when said handle is in said carrying/cutting position.

* * * * *